US011763409B2

(12) United States Patent
Trim et al.

(10) Patent No.: US 11,763,409 B2
(45) Date of Patent: Sep. 19, 2023

(54) DETERMINE PASSENGER DROP-OFF LOCATION BASED ON INFLUENCING FACTORS

(71) Applicant: INTERNATIONAL BUSINESS MACHINES CORPORATION, Armonk, NY (US)

(72) Inventors: Craig M. Trim, Ventura, CA (US); Sarbajit K. Rakshit, Kolkata (IN); James E. Bostick, Cedar Park, TX (US); Martin G. Keen, Cary, NC (US); John M. Ganci, Jr., Raleigh, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 17 days.

(21) Appl. No.: 17/224,213

(22) Filed: Apr. 7, 2021

(65) Prior Publication Data

US 2022/0327651 A1 Oct. 13, 2022

(51) Int. Cl.
*G06Q 50/30* (2012.01)
*G16Y 10/40* (2020.01)

(52) U.S. Cl.
CPC ..... *G06Q 50/30* (2013.01); *G16Y 10/40* (2020.01)

(58) Field of Classification Search
CPC .... G06Q 10/02; G06Q 50/30; G06Q 30/0609; G05D 1/0212; G05D 1/0088; G01C 21/3438; G01C 21/34; B60K 35/00
See application file for complete search history.

(56) References Cited

U.S. PATENT DOCUMENTS 9,296,395 B2 3/2016 Forcke
9,494,439 B1 11/2016 Ross
(Continued)

FOREIGN PATENT DOCUMENTS

KR 20200104881 A * 12/2018 ..... A61B 5/0816
WO WO-2017205822 A1 * 11/2017 ..... B60W 30/00
WO 2019226356 A1 11/2019

OTHER PUBLICATIONS

Y. Lyu, et al. "Flexi-Sharing: A Flexible and Personalized Taxi-Sharing System," in IEEE Transactions on Vehicular Technology, vol. 68, No. 10, pp. 9399-9413, Oct. 2019, doi: 10.1109/TVT.2019.2932869 <https://ieeexplore.ieee.org/document/8786246?source=IQplus> (Year: 2019).*

(Continued)

*Primary Examiner* — Jerry O'Connor
*Assistant Examiner* — Michael R Koester
(74) *Attorney, Agent, or Firm* — Robert R. Aragona

(57) ABSTRACT

An embodiment for determining a drop-off location of a passenger is provided. The embodiment may include receiving a pick-up location and drop-off location from one or more passengers. The embodiment may also include identifying the one or more passengers to be picked up from a passenger profile. The embodiment may further include identifying one or more factors associated with each passenger. The embodiment may also include in response to determining the drop-off location is not appropriate, notifying the one or more passengers of an alternative drop-off location. The embodiment may further include in response to determining the drop-off location is appropriate, dropping the one or more passengers off at the drop-off location. The embodiment may also include in response to determining the one or more passengers are not responsive to the notifica- (Continued)

tion, dropping each passenger who did not respond off at the alternative drop-off location.

17 Claims, 6 Drawing Sheets

(56) References Cited

U.S. PATENT DOCUMENTS

| | | | | |
|---|---|---|---|---|
| 9,733,096 | B2 | 8/2017 | Colijn | |
| 10,156,848 | B1 * | 12/2018 | Konrardy | G08G 1/20 |
| 2015/0219464 | A1 | 8/2015 | Beaurepaire | |
| 2016/0373473 | A1 * | 12/2016 | Truong | G01C 21/28 |
| 2018/0356239 | A1 | 12/2018 | Marco | |
| 2020/0103239 | A1 * | 4/2020 | Schwie | G08G 1/0141 |
| 2020/0142407 | A1 | 5/2020 | Kozloski | |
| 2022/0164911 | A1 * | 5/2022 | Stumpf | G06F 16/9537 |

OTHER PUBLICATIONS

Disclosed Anonymously, "Method and system for directing traffic flow and drop off points," IP.com No. IPCOM000254126D, IP Publication Date: Jun. 4, 2018, 4 pages.

IBM, "Autonomous vehicles—Watson IoT helps pave an industry revolution," Wired Brand Lab, Nov. 1, 2017, Retrieved from the Internet: <https://www.ibm.com/blogs/internet-of-things/iot-autonomous-vehicles/>, 5 pages.

IBM, automotive Archives—Business Operations, Retrieved from the Internet: <https://www.ibm.com/blogs/internet-of-things/tag/automotive/>, [accessed Jan. 22, 2021], 7 pages.

Mell et al. , "The NIST Definition of Cloud Computing", National Institute of Standards and Technology, Special Publication 800-145, Sep. 2011, 7 pages.

* cited by examiner

DETERMINE PASSENGER DROP-OFF LOCATION BASED ON INFLUENCING FACTORS

BACKGROUND

The present invention relates generally to the field of computing, and more particularly to a system for determining a drop-off location of a passenger based on influencing factors associated with the passenger.

Prior to travelling in a ride-booking service, the passenger may choose a pick-up location and a preferred drop-off location. Such pick-up locations and drop-off locations may be selected through a variety of means, such as mobile and desktop applications. A driver, or in the case of an autonomous vehicle, a computer, may pick up the passenger at the location of choosing and drop-off the passenger at another location. Currently, these ride-booking services have become a popular alternative to public transportation, which is often crowded and may run infrequently or at different times of the day. These ride-booking services may give passengers access to locations they may not have had access to previously, as well as peace of mind that they will return to their destination safely.

SUMMARY

According to one embodiment, a method, computer system, and computer program product for determining a drop-off location of a passenger is provided. The embodiment may include receiving a pick-up location and drop-off location from one or more passengers. The embodiment may also include identifying the one or more passengers to be picked up from a passenger profile. The embodiment may further include identifying one or more factors associated with each passenger based on the passenger profile of each passenger. The embodiment may also include determining whether the drop-off location is appropriate based on the one or more factors. The embodiment may further include in response to determining the drop-off location is not appropriate, notifying the one or more passengers of an alternative drop-off location.

BRIEF DESCRIPTION OF THE SEVERAL VIEWS OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. In the drawings.

DETAILED DESCRIPTION

Figure 1:
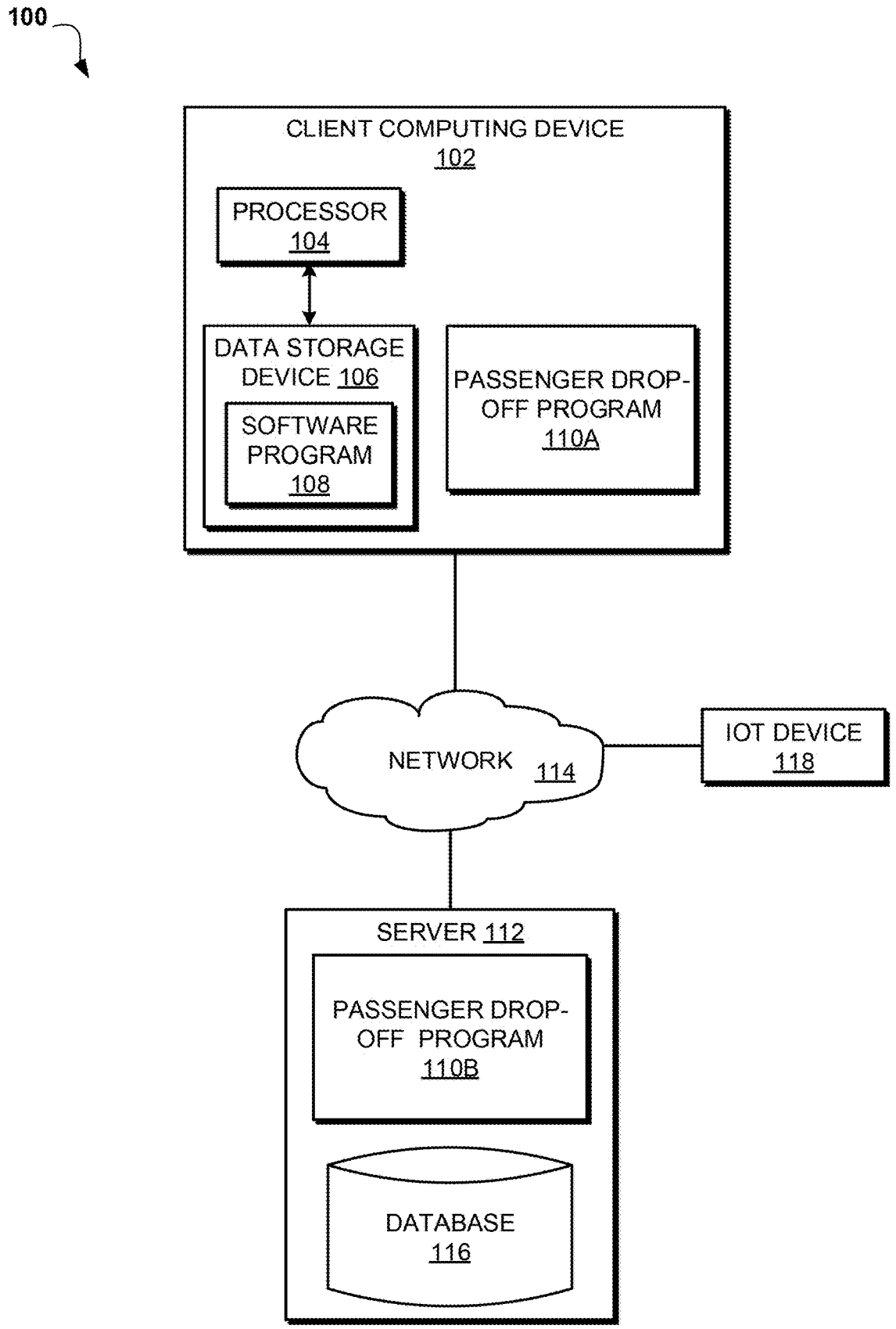
FIG. 1 illustrates an exemplary networked computer environment according to at least one embodiment.

Detailed embodiments of the claimed structures and methods are disclosed herein; however, it can be understood that the disclosed embodiments are merely illustrative of the claimed structures and methods that may be embodied in various forms. This invention may, however, be embodied in many different forms and should not be construed as limited to the exemplary embodiments set forth herein. In the description, details of well-known features and techniques may be omitted to avoid unnecessarily obscuring the presented embodiments.

It is to be understood that the singular forms "a," "an," and "the" include plural referents unless the context clearly dictates otherwise. Thus, for example, reference to "a component surface" includes reference to one or more of such surfaces unless the context clearly dictates otherwise.

Embodiments of the present invention relate to the field of computing, and more particularly to a system for determining a drop-off location of a passenger based on influencing factors associated with the passenger. The following described exemplary embodiments provide a system, method, and program product to, among other things, identify one or more factors associated with the passenger and, accordingly, drop off the passenger at an appropriate location. Therefore, the present embodiment has the capacity to improve the technical field of ride-booking applications by predicting whether a passenger-chosen destination is an appropriate drop-off location in a particular context.

As previously described, prior to travelling in a ride-booking service, the passenger may choose a pick-up location and a preferred drop-off location. Such pick-up locations and drop-off locations may be selected through a variety of means, such as mobile and desktop applications. A driver, or in the case of an autonomous vehicle, a computer, may pick up the passenger at the location of choosing and drop-off the passenger at another location. Currently, these ride-booking services have become a popular alternative to public transportation, which is often crowded and may run infrequently or at different times of the day. These ride-booking services may give passengers access to locations they may not have had access to previously, as well as peace of mind that they will return to their destination safely. According to different scenarios, the drop-off location originally chosen by the passenger may not be suitable in a particular context. For example, the passenger may need medical assistance, and therefore be taken to a hospital. This problem is typically addressed by providing to a driver, or computer system if an autonomous vehicle, suggested locations for pick up and drop off of the passenger, such as where the vehicle can legally pick up and drop off the passenger. However, suggesting locations in this manner fails to consider a cognitive state of the passenger, contextual risk of the drop-off location, and/or accessibility needs of the passenger. It may therefore be imperative to have a system in place to predict whether a passenger-chosen destination is an appropriate drop-off location based on these factors. Thus, embodiments of the present invention may provide advantages including, but not limited to, dynamically recommending alternative drop-off locations, enhancing passenger safety, and predicting the most appropriate drop-off location in a particular context. The present invention does not require that all advantages need to be incorporated into every embodiment of the invention.

According to at least one embodiment, when a passenger requests a ride in a for-hire vehicle (FHV), a pick-up location and a drop-off location may be received from the passenger via a ride-booking application. The passenger to be picked up may be identified from a passenger profile in order to identify one or more factors associated with the passenger. According to at least one embodiment, a factor may include a cognitive state of the passenger. According to at least one other embodiment, another factor may include a contextual risk level of the drop-off location. According to at least one further embodiment, another factor may include accessibility needs of the passenger. A determination of whether the drop-off location is appropriate may be made based on these one or more factors in order to drop off the passenger at the requested drop-off location or rather an alternative drop-off location.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed concurrently or substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The following described exemplary embodiments provide a system, method, and program product to identify one or more factors associated with the passenger and, accordingly, drop off the passenger at an appropriate location.

Referring to FIG. 1, an exemplary networked computer environment 100 is depicted, according to at least one embodiment. The networked computer environment 100 may include client computing device 102, a server 112, and Internet of Things (IoT) Device 118 interconnected via a communication network 114. According to at least one implementation, the networked computer environment 100 may include a plurality of client computing devices 102 and servers 112, of which only one of each is shown for illustrative brevity.

The communication network 114 may include various types of communication networks, such as a wide area network (WAN), local area network (LAN), a telecommunication network, a wireless network, a public switched network and/or a satellite network. The communication network 114 may include connections, such as wire, wireless communication links, or fiber optic cables. It may be appreciated that FIG. 1 provides only an illustration of one implementation and does not imply any limitations with regard to the environments in which different embodiments may be implemented. Many modifications to the depicted environments may be made based on design and implementation requirements.

Client computing device 102 may include a processor 104 and a data storage device 106 that is enabled to host and run a software program 108 and a passenger drop-off program 110A and communicate with the server 112 and IoT Device 118 via the communication network 114, in accordance with one embodiment of the invention. Client computing device 102 may be, for example, a mobile device, a telephone, a personal digital assistant, a netbook, a laptop computer, a tablet computer, a desktop computer, or any type of computing device capable of running a program and accessing a network. As will be discussed with reference to FIG. 4, the client computing device 102 may include internal components 402*a* and external components 404*a*, respectively.

The server computer 112 may be a laptop computer, netbook computer, personal computer (PC), a desktop computer, or any programmable electronic device or any network of programmable electronic devices capable of hosting and running a passenger drop-off program 110B and a database 116 and communicating with the client computing device 102 and IoT Device 118 via the communication network 114, in accordance with embodiments of the invention. As will be discussed with reference to FIG. 4, the server computer 112 may include internal components 402*b* and external components 404*b*, respectively. The server 112 may also operate in a cloud computing service model, such as Software as a Service (SaaS), Platform as a Service (PaaS), or Infrastructure as a Service (IaaS). The server 112 may also be located in a cloud computing deployment model, such as a private cloud, community cloud, public cloud, or hybrid cloud.

IoT Device 118 may be a camera embedded in a vehicle and/or client computing device 102, a GPS device, a sound sensor, a motion sensor, a microphone, a wearable device, and any other IoT Device 118 known in the art for capturing images, detecting objects, and/or identifying vehicle location, capable of connecting to the communication network 114, and transmitting and receiving data with the client computing device 102 and the server 112.

According to the present embodiment, the passenger drop-off program 110A, 110B may be a program capable of receiving pickup and destination locations of a passenger, identifying one or more factors associated with the passenger, directing a FHV driver or autonomous vehicle to proceed to an appropriate location, dynamically recommending alternative drop-off locations, enhancing passenger safety, and predicting the most appropriate drop-off location in a particular context. The passenger drop-off determination method is explained in further detail below with respect to FIG. 2.

Figure 2:
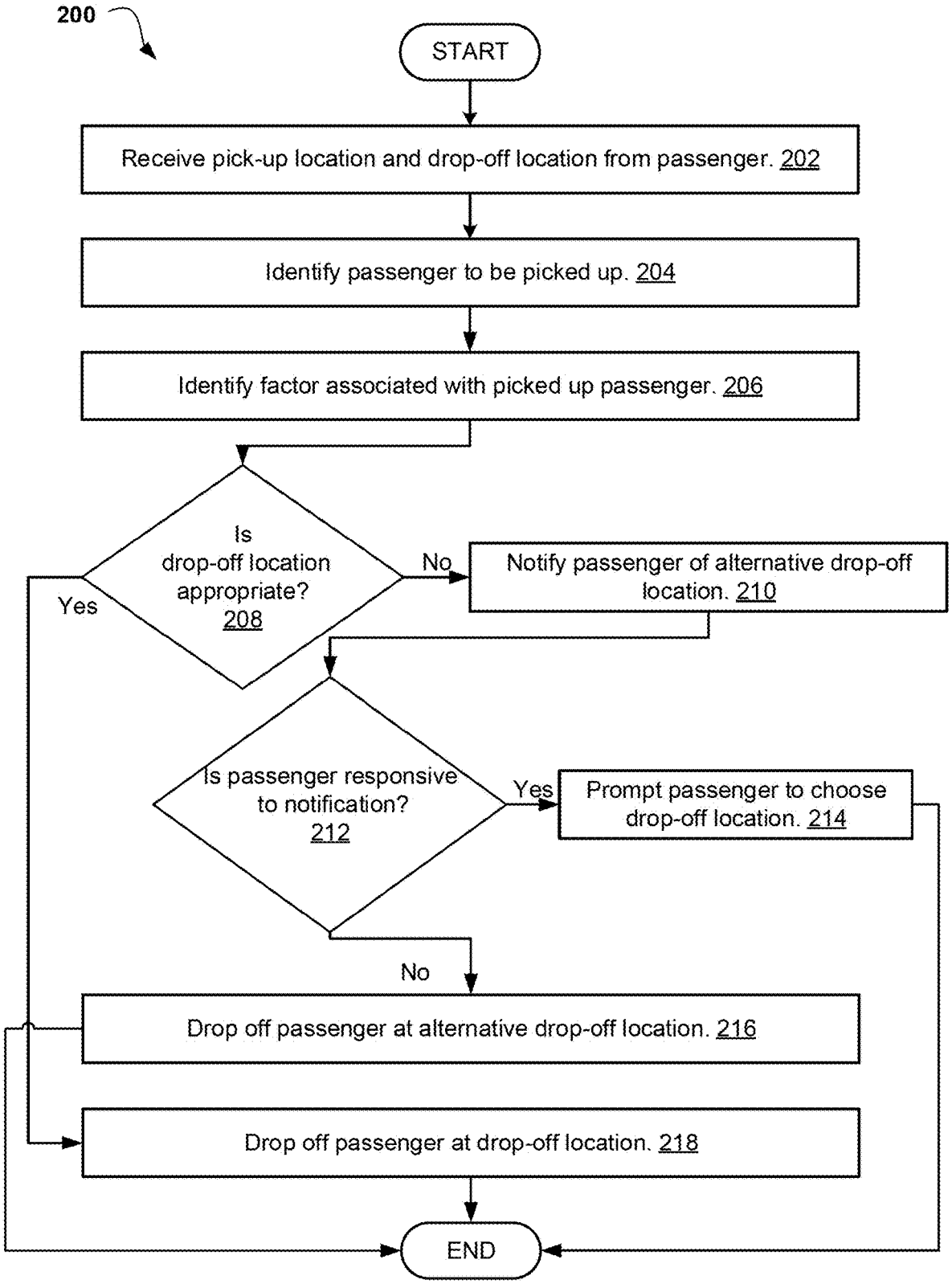
FIG. 2 illustrates an operational flowchart for determining a drop-off location of a passenger in a passenger drop-off determination process according to at least one embodiment.

Referring now to FIG. 2, an operational flowchart for determining a drop-off location of a passenger in a passenger drop-off determination process 200 is depicted according to at least one embodiment. At 202, the passenger drop-off program 110A, 110B receives the pick-up location and the drop-off location from one or more passengers. As used herein, "passenger" means any person in a vehicle who is not actively driving the vehicle. In the event that there is more than one passenger, these passengers may be part of the same party, or they may be passengers using a "pool" option, i.e., sharing a ride with unknown people to reduce cost. For purposes of embodiments of the present invention, reference to "one or more passengers" means passengers who are not in the same party. Passengers in the same party will be treated as one passenger, i.e., a primary passenger who is booking the ride. The one or more passengers may use a mobile or desktop application having access to GPS to book a ride in a ride-sharing car service, such as Uber® (Uber and all Uber-based trademarks and logos are trademarks or registered trademarks of Uber Technologies, Inc. and/or its affiliates) or Lyft® (Lyft and all Lyft-based trademarks and logos are trademarks or registered trademarks of Lyft, Inc. and/or its affiliates). Alternatively, the pick-up and drop-off locations may be defined by a third party, i.e., a person who is not actually a passenger. For example, the passenger, or third party, may request for the passenger to be picked up at their home address and dropped off at a location of choice, such as a restaurant or event venue. It may be appreciated that embodiments of the present invention work in both traditional vehicles, as well as autonomous vehicles.

Then, at 204, the passenger drop-off program 110A, 110B identifies the one or more passengers to be picked up. A passenger profile of each passenger is used to identify the one or more passengers. For example, as described above, Uber®, Lyft®, and other ride-sharing services have mobile and/or desktop applications in which a passenger may register and create a profile. This profile may include certain features about the passenger, including but not limited to age, gender, name, home address, and accessibility needs. Examples of accessibility needs include, but are not limited to access to a wheelchair ramp, a maximum distance to walk from the drop-off location, as well as additional needs due to poor weather conditions. In embodiments of the present invention, this profile may also include a risk tolerance level for the passenger. The risk tolerance level may be a 1-5 rating, where "1" may indicate a low risk tolerance and "5" may indicate a high risk tolerance. According to at least one embodiment, this risk tolerance may be chosen by the passenger. According to at least one other embodiment, the passenger drop-off program 110A, 110B may learn the risk tolerance from the passenger's previous ride history. For example, a business traveler may live in California and have high risk tolerance. When travelling to another state that is unfamiliar to the traveler, such traveler may select a lower risk tolerance. In such a case, the passenger drop-off program 110A, 110B may automatically select a lower risk tolerance any time the traveler is outside California.

According to at least one further embodiment, where the passenger does not have a registered profile, the identification may be made in the vehicle itself using any of the following:

Manually, in which the passenger enters their identity in the text of the reservation and/or an interaction between a vehicle interface and the passenger. For example, Passenger "A" may identify himself in a confirmation text message and his drop-off location, and Passenger "B" may identify herself on a touchscreen as well as her drop-off location;

By facial recognition, in which the IoT device 118, such as a camera internal or external to the vehicle, captures an image of the passenger and streams the image to a cognitive system for facial recognition analysis; and By voice, in which the IoT device 118, such as a microphone in the vehicle, captures the voice of the passenger and streams the voice content to the cognitive system for voice recognition analysis. It may be appreciated that conversations between passengers or conversations between the passenger and the driver are not recorded.

In the present embodiment, at 206, the passenger drop-off program 110A, 110B identifies the one or more factors associated with each passenger. The one or more factors are identified based on the information in the passenger profile of each passenger and/or by utilizing a plurality of IoT devices 118. The factors are discussed in detail below.

According to at least one embodiment, the factor may be the cognitive state of the passenger. When the passenger makes a reservation, the passenger profile information may be retrieved from a database, such as the database 116. Each passenger profile may include a profile of the passenger's cognitive state. For example, the passenger may be tired around 9 p.m. on a weekday after work. Examples of cognitive states which may be identified include, but are not limited to, alert, asleep, distracted, ill, intoxicated, and angry. The vehicle may be equipped with IoT devices 118 such as cameras and microphones to identify these cognitive states. Other IoT devices 118 belonging to the passenger, such as a smartwatch and/or smartphone may also be used to identify biometrics of the passenger. The camera video, audio, and/or biometrics may be analyzed by a local edge computing system or streamed to a remote artificial intelligence (AI) system to identify the cognitive state. For example, if the passenger is speaking above a pre-defined decibel (dB) level, the passenger drop-off program 110A, 110B may identify the cognitive state as angry. Continuing the example, if the camera detects the passenger in a slumped position, and the smartwatch detects the heartrate falling below a pre-defined safety threshold level, the passenger drop-off program 110A, 110B may identify that the passenger is ill and in need of medical attention.

According to at least one other embodiment, the factor may be the contextual risk level of the drop-off location. As described above with respect to step 204, the passenger may have a risk tolerance level between "1" and "5." In addition to the passenger risk tolerance level, the drop-off location may also be assigned a contextual risk level between "1" and "5." The drop-off location may vary in risk depending on the context. The IoT devices 118 in the vehicle may analyze the context of the drop-off location in real-time. For example, when the vehicle pulls up to the drop-off location, the camera may detect that a group of people has gathered. If it is dark outside, the contextual risk may be high. Continuing the example, if it is 11 p.m., the passenger drop-off program may identify the contextual risk as "4," i.e., higher risk. In this instance, if the passenger's risk tolerance is "3," the contextual risk exceeds the passenger risk tolerance, and an alternative drop-off location may be necessary. According to at least one other embodiment, the contextual risk may be identified based on historical information at the drop-off location. For example, each time a vehicle pulls up to a drop-off location, certain information may be recorded, such as address of the drop-off location, time, event, criminal activity, passenger voice comments and/or facial reactions, traffic, and accessibility accommodations, i.e., if a wheelchair ramp is present. This information may be accessed by any vehicle within the network when dropping off a passenger at the same location in the future. According to at least one further embodiment, the contextual risk may be provided by the passengers themselves. For example, the passenger may report a concert is taking place at a particular drop-off location.

According to at least one further embodiment, the factor may be the accessibility needs of the passenger. As described above with respect to step 204, the passenger profile may include accessibility needs of the passenger. For example, one passenger may need a wheelchair access ramp at the drop-off location. In another example, a passenger may have a medical condition and require shelter from the rain or sun. Alternatively, where the passenger does not have a profile, the passenger may enter their accessibility needs into the passenger drop-off program 110A, 110B manually or by voice as described above with respect to step 204.

In the present embodiment, at 208, the passenger drop-off program 110A, 110B determines whether the drop-off location is appropriate. The determination is made based on the one or more factors.

In embodiments where the factor includes the cognitive state of the passenger, the particular cognitive state at a given time may be indicative of a suitable drop-off location. For example, the given time may be 15 minutes prior to scheduled drop-off. Continuing the example described above with respect to step 206, where the camera in the vehicle detects the passenger in a slumped position, and the smartwatch detects the heartrate falling below a pre-defined safety threshold level, the passenger drop-off program 110A, 110B may determine the drop-off location originally chosen by the passenger is not appropriate and may recommend the alternative drop-off location, described in further detail below with respect to step 210.

In embodiments where the factor includes the contextual risk level of the drop-off location, a comparison between the passenger risk tolerance level and the contextual risk level of the drop-off location at a given time may be indicative of a suitable drop-off location. Continuing the example described above with respect to step 206, where the current contextual risk at the drop-off location is "4" and the passenger's risk tolerance is "3," the passenger drop-off program 110A, 110B may determine the drop-off location originally chosen by the passenger is not appropriate and may recommend the alternative drop-off location, described in further detail below with respect to step 210.

In embodiments where the factor includes the accessibility needs of the passenger, a comparison between the accessibility needs of the passenger and the accessibility features of the drop-off location may be indicative of a suitable drop-off location. Continuing the example described above with respect to step 206, where one passenger may need a wheelchair access ramp at the drop-off location, the passenger drop-off program 110A, 110B may retrieve information from the database, such as database 116, relating to accessibility features at the drop-off location. If the information retrieved from the database indicates that there is no wheelchair access ramp at the drop-off location, the passenger drop-off program 110A, 110B may determine the drop-off location originally chosen by the passenger is not appropriate and may recommend the alternative drop-off location, described in further detail below with respect to step 210. Alternatively, the accessibility features may be identified in real-time. Continuing the example described above with respect to step 206, where the passenger has a medical condition and requires shelter from the rain or sun, when the vehicle pulls up to the drop-off location and the camera is unable to detect some form of shelter, e.g., a roof or enclosure, the drop-off location may also be determined unsuitable.

In response to determining the drop-off location is not appropriate, the passenger drop-off determination process 200 may proceed to step 210 to notify the one or more passengers of the alternative drop-off location. In response to determining the drop-off location is appropriate, the passenger drop-off determination process 200 may proceed to step 218 to drop the passenger off at the drop-off location as originally scheduled.

Then, at 210, the passenger drop-off program 110A, 110B notifies the one or more passengers of the alternative drop-off location. The notification may be a push notification sent to the passenger's smartphone, a text message sent to the passenger's smartphone, or any electronic device capable of receiving a notification. For example, if the data received from the biometric device of the passenger indicates the passenger requires medical attention, the alternative drop-off location recommended may be a hospital or medical center. The notification may also include the reason why that particular alternative drop-off location is recommended. For example, the notification could say, "You are not feeling well, please seek medical attention." According to at least one other embodiment, the alternative drop-off location may be recommended based on historical information gathered for the passenger. For example, when the passenger is angry, such passenger may typically go to a parent's home to calm down. Thus, one alternative drop-off location may be the parent's address.

Next, at 212, the passenger drop-off program 110A, 110B determines whether the one or more passengers are responsive to the notification. A pop-up on the passenger's electronic device may ask the passenger if they received the notification with a box to tap for "Yes" and a box to tap for "No." According to at least one embodiment, the passenger may save in the passenger profile a maximum number of notifications and/or a time period in which to respond to the notification before the passenger drop-off program 110A, 110B takes the next action. For example, the passenger may wish to be notified twice, via two pop-ups, and be given a period of 15 seconds to respond. According to at least one further embodiment, if the passenger does not respond, an emergency contact of the passenger may choose the drop-off location as scheduled or the alternative drop-off location. The emergency contact may also be stored in the passenger profile. In response to determining the one or more passengers are not responsive to the notification, the passenger drop-off determination process 200 may proceed to step 216 to drop-off the one or more passengers at the alternative drop-off location based on the one or more factors. In response to determining the one or more passengers are responsive to the notification, the passenger drop-off determination process 200 may proceed to step 214 to prompt the one or more passengers to choose the drop-off location or the alternative drop-off location.

Then, at 214, the passenger drop-off program 110A, 110B prompts the one or more passengers who did respond to choose the drop-off location or the alternative drop-off location as their destination. In a similar manner to step 212 described above, the pop-up may ask the user to choose the drop-off location as originally scheduled, or to choose the recommended alternative drop-off location. The passenger's selection may be saved in the passenger profile for future analysis in recommending an alternative drop-off location. For example, if the passenger rejected the alternative drop-off location, that particular alternative drop-off location may not be recommended again in the same context.

Next, at 216, the passenger drop-off program 110A, 110B drops off the one or more passengers who did not respond at the alternative drop-off location. This may be done automatically assuming the passenger gives permission to be taken to an alternative drop-off location. Permission may be given in the passenger profile, or at the time of pick up. For example, if the passenger is feeling ill and gave permission to be taken to the alternative drop-off location, the passenger may be taken to the hospital or medical center. If permission is denied, the passenger may be taken to their original drop-off location.

Then, at 218, the passenger drop-off program 110A, 110B drops off the one or more passengers at the drop-off location. As described above with respect to step 208, the one or more passengers may be dropped off at the drop-off location when the passenger drop-off program 110A, 110B determines the original drop-off location to be appropriate. This determination may be made based on the one or more factors. For example, if the passenger's cognitive state is identified as awake and alert, the alternative drop-off location may not be necessary. The passenger may also be taken to the drop-off location when choosing the drop-off location after being prompted as described above with respect to step 214. Additionally, in situations where the passenger does not give permission to be taken to the alternative drop-off location as described above with respect to step 216, the passenger may be dropped off at the drop-off location.

Figure 3:
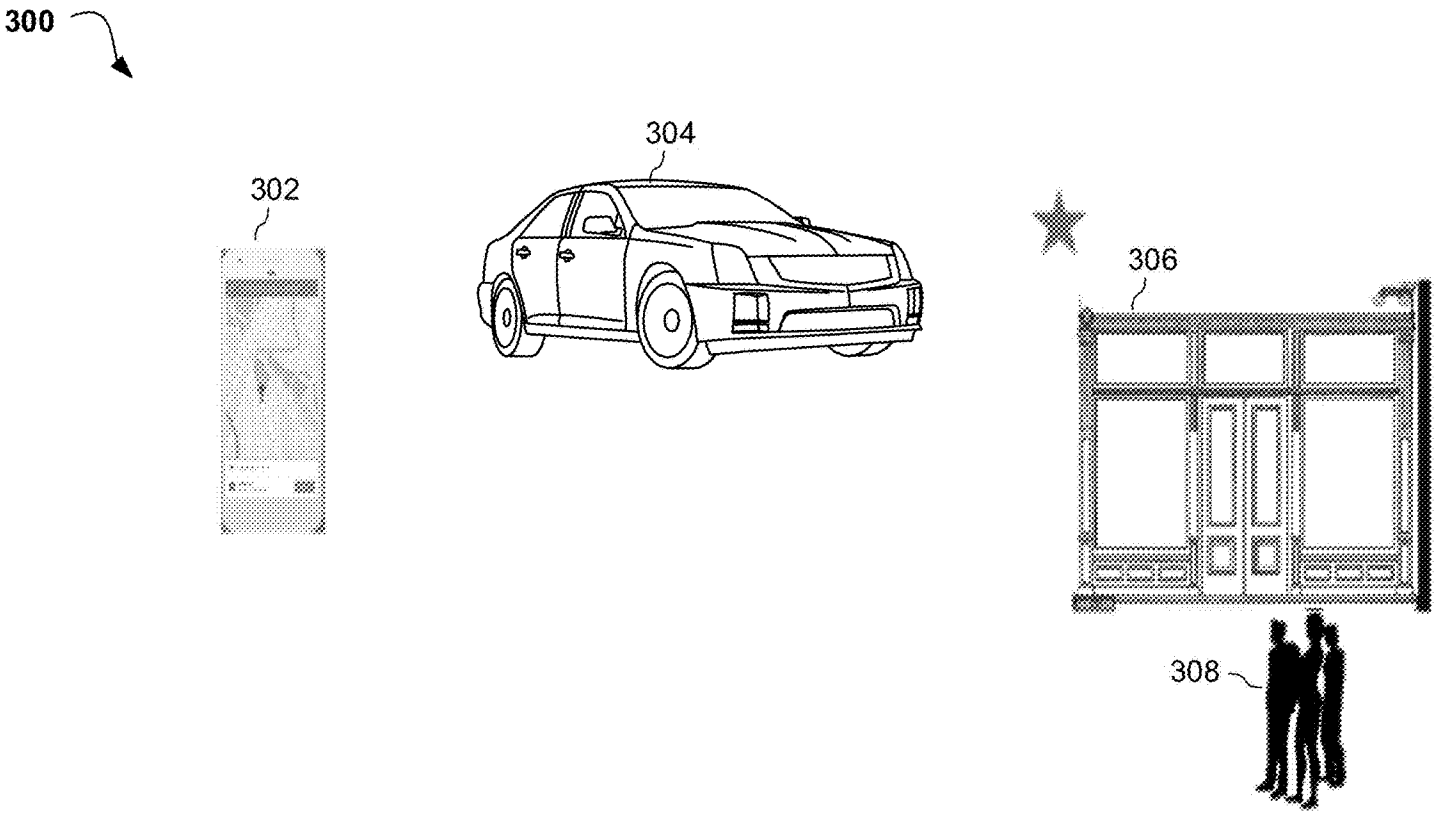
FIG. 3 is a diagram depicting a ride-booking service vehicle analyzing the contextual situation of a drop-off location according to at least one embodiment.

Referring now to FIG. 3, a diagram 300 depicting the ride-booking service vehicle 304 analyzing the contextual situation of the drop-off location 306 is shown according to at least one embodiment. The IoT device 118 (FIG. 1) in the ride-booking service vehicle 304 detects a group of people 308 who have gathered at the drop-off location 306. The passenger drop-off program 110A, 110B (FIG. 1) analyzes the contextual risk level at the drop-off location 306 and compares the contextual risk level with the passenger's risk tolerance level. If the contextual risk level at the drop-off location 306 exceeds the passenger's risk tolerance level, the passenger in the ride-booking service vehicle 304 may receive a notification on their device 302 that the drop-off location is not currently suitable for drop off. The passenger drop-off program 110A, 110B may recommend an alternative drop-off location that conforms to the passenger's risk tolerance level. The recommendation may appear as a pop-up on the passenger's device 302 and may be accepted or rejected by the passenger. If the passenger taps the box on the device 302 to accept the alternative drop-off location, the ride-booking service vehicle 304 may proceed to the alternative drop-off location. In contrast, if the passenger taps the box on the device 302 to reject the alternative drop-off location, the ride-booking service vehicle 304 may proceed to the drop-off location 306 in spite of the group of people 308.

It may be appreciated that FIGS. 2 and 3 provide only an illustration of one implementation and do not imply any limitations with regard to how different embodiments may be implemented. Many modifications to the depicted environments may be made based on design and implementation requirements.

Figure 4:
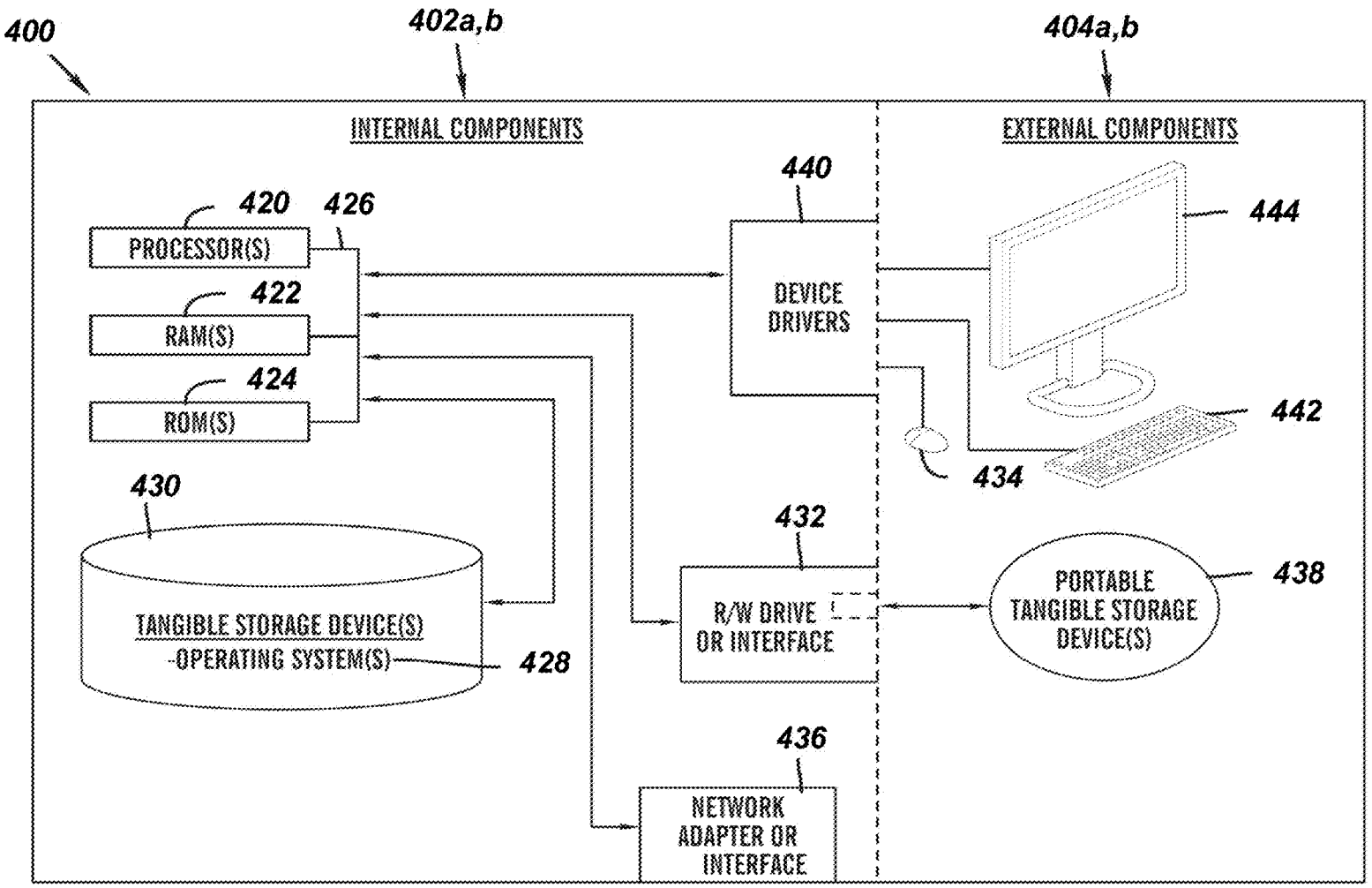
FIG. 4 is a functional block diagram of internal and external components of computers and servers depicted in FIG. 1 according to at least one embodiment.

FIG. 4 is a block diagram 400 of internal and external components of the client computing device 102 and the server 112 depicted in FIG. 1 in accordance with an embodiment of the present invention. It should be appreciated that FIG. 4 provides only an illustration of one implementation and does not imply any limitations with regard to the environments in which different embodiments may be implemented. Many modifications to the depicted environments may be made based on design and implementation requirements.

The data processing system 402, 404 is representative of any electronic device capable of executing machine-readable program instructions. The data processing system 402, 404 may be representative of a smart phone, a computer system, PDA, or other electronic devices. Examples of computing systems, environments, and/or configurations that may represented by the data processing system 402, 404 include, but are not limited to, personal computer systems, server computer systems, thin clients, thick clients, handheld or laptop devices, multiprocessor systems, microprocessor-based systems, network PCs, minicomputer systems, and distributed cloud computing environments that include any of the above systems or devices.

The client computing device 102 and the server 112 may include respective sets of internal components 402 *a,b* and external components 404 *a,b* illustrated in FIG. 4. Each of the sets of internal components 402 include one or more processors 420, one or more computer-readable RAMs 422, and one or more computer-readable ROMs 424 on one or more buses 426, and one or more operating systems 428 and one or more computer-readable tangible storage devices 430. The one or more operating systems 428, the software program 108 and the passenger drop-off program 110A in the client computing device 102 and the passenger drop-off program 110B in the server 112 are stored on one or more of the respective computer-readable tangible storage devices 430 for execution by one or more of the respective processors 420 via one or more of the respective RAMs 422 (which typically include cache memory). In the embodiment illustrated in FIG. 4, each of the computer-readable tangible storage devices 430 is a magnetic disk storage device of an internal hard drive. Alternatively, each of the computer-readable tangible storage devices 430 is a semiconductor storage device such as ROM 424, EPROM, flash memory or any other computer-readable tangible storage device that can store a computer program and digital information.

Each set of internal components 402 *a,b* also includes a R/W drive or interface 432 to read from and write to one or more portable computer-readable tangible storage devices 438 such as a CD-ROM, DVD, memory stick, magnetic tape, magnetic disk, optical disk or semiconductor storage device. A software program, such as the passenger drop-off program 110A, 110B, can be stored on one or more of the respective portable computer-readable tangible storage devices 438, read via the respective R/W drive or interface 432, and loaded into the respective hard drive 430.

Each set of internal components 402 *a,b* also includes network adapters or interfaces 436 such as a TCP/IP adapter cards, wireless Wi-Fi interface cards, or 3G or 4G wireless interface cards or other wired or wireless communication links. The software program 108 and the passenger drop-off program 110A in the client computing device 102 and the passenger drop-off program 110B in the server 112 can be downloaded to the client computing device 102 and the server 112 from an external computer via a network (for example, the Internet, a local area network or other, wide area network) and respective network adapters or interfaces 436. From the network adapters or interfaces 436, the software program 108 and the passenger drop-off program 110A in the client computing device 102 and the passenger drop-off program 110B in the server 112 are loaded into the respective hard drive 430. The network may comprise copper wires, optical fibers, wireless transmission, routers, firewalls, switches, gateway computers and/or edge servers.

Each of the sets of external components 404 *a,b* can include a computer display monitor 444, a keyboard 442, and a computer mouse 434. External components 404 *a,b* can also include touch screens, virtual keyboards, touch pads, pointing devices, and other human interface devices. Each of the sets of internal components 402 *a,b* also includes device drivers 440 to interface to computer display monitor 444, keyboard 442, and computer mouse 434. The device drivers 440, R/W drive or interface 432, and network adapter or interface 436 comprise hardware and software (stored in storage device 430 and/or ROM 424).

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 5:
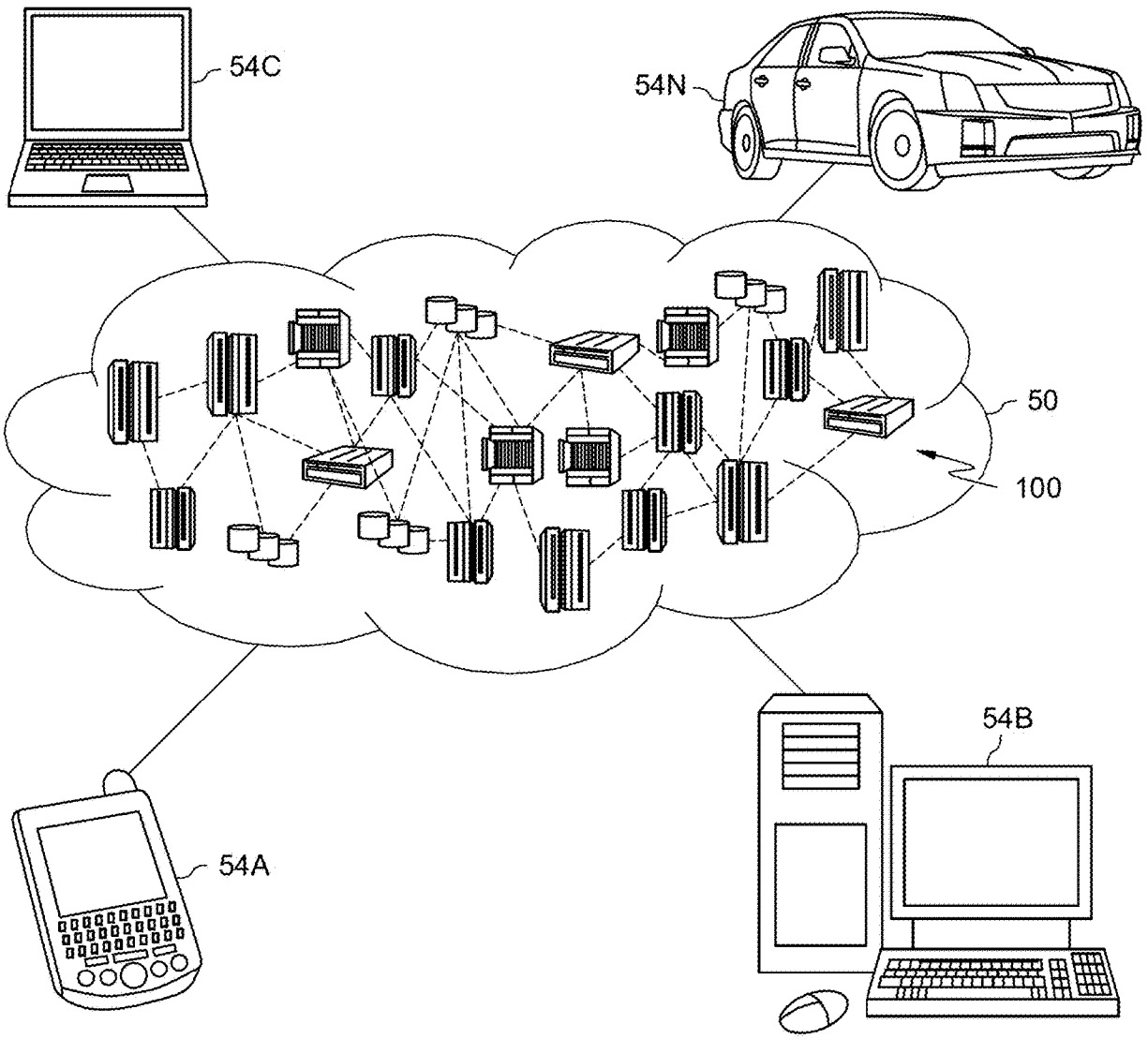
FIG. 5 depicts a cloud computing environment according to an embodiment of the present invention.

Referring now to FIG. 5, illustrative cloud computing environment 50 is depicted. As shown, cloud computing environment 50 comprises one or more cloud computing nodes 100 with which local computing devices used by cloud consumers, such as, for example, personal digital assistant (PDA) or cellular telephone 54A, desktop computer 54B, laptop computer 54C, and/or automobile computer system 54N may communicate. Nodes 100 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 5 are intended to be illustrative only and that computing nodes 100 and cloud computing environment 50 can communicate with any type of computerized device over any type of network and/or network addressable connection (e.g., using a web browser).

Figure 6:
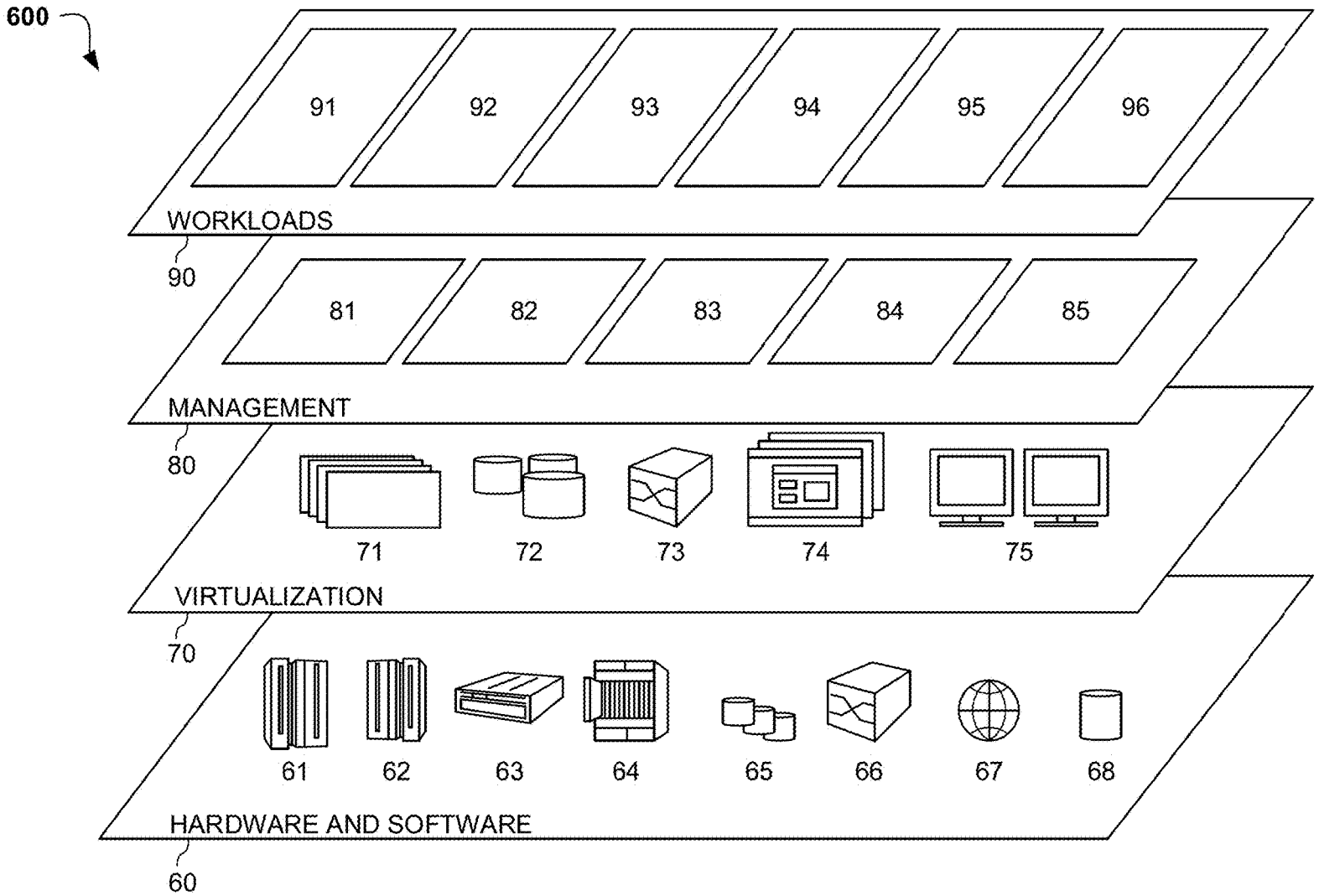
FIG. 6 depicts abstraction model layers according to an embodiment of the present invention.

Referring now to FIG. 6, a set of functional abstraction layers 600 provided by cloud computing environment 50 is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and determining a drop-off location of a passenger based on influencing factors 96.

Determining a drop-off location of a passenger based on influencing factors 96 may relate to identifying one or more factors associated with the passenger in order to drop off the passenger at an appropriate location.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-based method of determining a drop-off location of a passenger, the method comprising:

receiving a pick-up location and a drop-off location from one or more passengers;

identifying the one or more passengers to be picked up from a passenger profile of each passenger;

identifying one or more factors associated with each passenger based on the passenger profile of each passenger, wherein at least one factor is a cognitive state of the passenger detected by a camera embedded in an autonomous vehicle, wherein the embedded camera is oriented to exclude a driver and only capture an image of each passenger;

determining whether the drop-off location is appropriate based on the one or more factors including the cognitive state of the passenger;

in response to determining the drop-off location is not appropriate, notifying the one or more passengers of an alternative drop-off location;

determining whether the one or more passengers are responsive to the notification; and in response to determining the one or more passengers are not responsive to the notification, automatically controlling the autonomous vehicle to drop-off each passenger who did not respond off at the alternative drop-off location.

2. The method of claim 1, further comprising:

in response to determining the one or more passengers are responsive to the notification, prompting each passenger who did respond to choose the drop-off location or the alternative drop-off location.

3. The method of claim 1, further comprising:

in response to determining the drop-off location is appropriate, dropping the one or more passengers off at the drop-off location.

4. The method of claim 1, wherein the factor is selected from a group consisting of a contextual risk level of the drop off location, and accessibility needs of the one or more passengers.

5. The method of claim 1, further comprising:

determining whether the one or more passengers are responsive to the notification; and in response to determining the one or more passengers are not responsive to the notification, notifying an emergency contact of each passenger who did not respond to choose the drop-off location or the alternative drop-off location.

6. The method of claim 1, wherein a plurality of IoT devices are utilized to identify the one or more factors.

7. A computer system, the computer system comprising:

one or more processors, one or more computer-readable memories, one or more computer-readable tangible storage medium, and program instructions stored on at least one of the one or more tangible storage medium for execution by at least one of the one or more processors via at least one of the one or more memories, wherein the computer system is capable of performing a method comprising:

receiving a pick-up location and a drop-off location from one or more passengers;

identifying the one or more passengers to be picked up from a passenger profile of each passenger;

identifying one or more factors associated with each passenger based on the passenger profile of each passenger, wherein at least one factor is a cognitive state of the passenger detected by a camera embedded in an autonomous vehicle, wherein the embedded camera is oriented to exclude a driver and only capture an image of each passenger;

determining whether the drop-off location is appropriate based on the one or more factors including the cognitive state of the passenger;

in response to determining the drop-off location is not appropriate, notifying the one or more passengers of an alternative drop-off location;

determining whether the one or more passengers are responsive to the notification; and in response to determining the one or more passengers are not responsive to the notification, automatically controlling the autonomous vehicle to drop-off each passenger who did not respond off at the alternative drop-off location.

8. The computer system of claim 7, further comprising:

in response to determining the one or more passengers are responsive to the notification, prompting each passenger who did respond to choose the drop-off location or the alternative drop-off location.

9. The computer system of claim 7, further comprising:

in response to determining the drop-off location is appropriate, dropping the one or more passengers off at the drop-off location.

10. The computer system of claim 7, wherein the factor is selected from a group consisting of a contextual risk level of the drop off location, and accessibility needs of the one or more passengers.

11. The computer system of claim 7, further comprising:

determining whether the one or more passengers are responsive to the notification; and in response to determining the one or more passengers are not responsive to the notification, notifying an emergency contact of each passenger who did not respond to choose the drop-off location or the alternative drop-off location.

12. The computer system of claim 7, wherein a plurality of IoT devices are utilized to identify the one or more factors.

13. A computer program product, the computer program product comprising:

one or more computer-readable tangible storage medium and program instructions stored on at least one of the one or more tangible storage medium, the program instructions executable by a processor capable of performing a method, the method comprising:

receiving a pick-up location and a drop-off location from one or more passengers;

identifying the one or more passengers to be picked up from a passenger profile of each passenger;

identifying one or more factors associated with each passenger based on the passenger profile of each passenger, wherein at least one factor is a cognitive state of the passenger detected by a camera embedded in an autonomous vehicle, wherein the embedded camera is oriented to exclude a driver and only capture an image of each passenger;

determining whether the drop-off location is appropriate based on the one or more factors including the cognitive state of the passenger;

in response to determining the drop-off location is not appropriate, notifying the one or more passengers of an alternative drop-off location;

determining whether the one or more passengers are responsive to the notification; and in response to determining the one or more passengers are not responsive to the notification, automatically controlling the autonomous vehicle to drop-off each passenger who did not respond off at the alternative drop-off location.

14. The computer program product of claim 13, further comprising:

in response to determining the one or more passengers are responsive to the notification, prompting each passenger who did respond to choose the drop-off location or the alternative drop-off location.

15. The computer program product of claim 13, further comprising:

in response to determining the drop-off location is appropriate, dropping the one or more passengers off at the drop-off location.

16. The computer program product of claim 13, wherein the factor is selected from a group consisting of a contextual risk level of the drop off location, and accessibility needs of the one or more passengers.

17. The computer program product of claim 13, further comprising:

determining whether the one or more passengers are responsive to the notification; and in response to determining the one or more passengers are not responsive to the notification, notifying an emergency contact of each passenger who did not respond to choose the drop-off location or the alternative drop-off location.

* * * * *